US008747166B2

(12) United States Patent
Yamada et al.

(10) Patent No.: US 8,747,166 B2
(45) Date of Patent: Jun. 10, 2014

(54) CONNECTOR AND CONNECTOR SET

(75) Inventors: Daisuke Yamada, Yokosuka (JP); Mikio Yamasaki, Mitaka (JP); Takashi Takeda, Fukuoka (JP); Akira Matsumoto, Tokyo (JP)

(73) Assignees: Furukawa Electric Power Systems Co., Ltd., Yokohama-Shi (JP); NTT Facilities, Inc., Tokyo (JP)

( * ) Notice: Subject to any disclaimer, the term of this patent is extended or adjusted under 35 U.S.C. 154(b) by 51 days.

(21) Appl. No.: 13/517,352

(22) PCT Filed: May 13, 2011

(86) PCT No.: PCT/JP2011/061017

§ 371 (c)(1),
(2), (4) Date: Jun. 20, 2012

(87) PCT Pub. No.: WO2011/145512

PCT Pub. Date: Nov. 24, 2011

(65) Prior Publication Data

US 2012/0258638 A1 Oct. 11, 2012

(30) Foreign Application Priority Data

May 21, 2010 (JP) ..... 2010-117548

(51) Int. Cl.
*H01R 13/64* (2006.01)

(52) U.S. Cl.
USPC ..... 439/680

(58) Field of Classification Search
USPC ..... 439/312–323, 332–337, 677, 680, 681
See application file for complete search history.

(56) References Cited

U.S. PATENT DOCUMENTS

| | | | | | |
|---|---|---|---|---|---|
| 3,901,574 | A | * | 8/1975 | Paullus et al. | 439/315 |
| 4,059,324 | A | * | 11/1977 | Snyder et al. | 439/321 |
| 4,111,514 | A | * | 9/1978 | Brishka et al. | 439/680 |
| 4,229,064 | A | * | 10/1980 | Vetter et al. | 439/680 |
| 4,289,368 | A | * | 9/1981 | Schildkraut | 439/320 |
| 4,423,919 | A | * | 1/1984 | Hillis | 439/607.17 |
| 4,497,530 | A | * | 2/1985 | Shannon | 439/312 |
| 5,662,488 | A | * | 9/1997 | Alden | 439/314 |

(Continued)

FOREIGN PATENT DOCUMENTS

| | | |
|---|---|---|
| JP | A-04-259769 | 9/1992 |
| JP | A-10-284182 | 10/1998 |
| JP | A-2000-208209 | 7/2000 |
| JP | A-2002-075542 | 3/2002 |

OTHER PUBLICATIONS

International Search Report issued in International Application No. PCT/JP2011/061017 dated Jun. 14, 2011 (with translation).

*Primary Examiner* — Ross Gushi
(74) *Attorney, Agent, or Firm* — Oliff PLC

(57) ABSTRACT

A connector etc. that prevents wrong insertion and does not require large rotation of plug etc., when inserting a plug to a socket, is provided. Plug-in connector 1 comprises pin plug 10 and receptacle 20, and pin plug 10 and receptacle 20 are connected. On pin cover body 14 of pin plug 10, plural pin plug key protrusions 15 are constructed separately along the circumferential direction, and on socket cover 27 of receptacle 20, plural sets 28*a*-28*e* of plural key grooves 28 separated along the circumferential direction, that plural pin plug key protrusions 15 fit into each set, are arranged with shifting along the circumferential direction. Receptacle 20 can be substituted by a socket plug 30.

4 Claims, 11 Drawing Sheets

(56) References Cited

U.S. PATENT DOCUMENTS

| | | | | |
|---|---|---|---|---|
| 6,685,493 | B2 * | 2/2004 | Birkenmaier et al. | 439/314 |
| 7,641,517 | B2 * | 1/2010 | Vogt et al. | 439/620.02 |
| 7,736,196 | B1 * | 6/2010 | Isaac et al. | 439/680 |
| 8,025,536 | B1 * | 9/2011 | Kelly | 439/681 |
| 8,040,032 | B2 * | 10/2011 | Kovacs | 313/318.01 |
| 8,328,574 | B1 * | 12/2012 | Lin | 439/321 |
| 2003/0013338 | A1 * | 1/2003 | Birkenmaier et al. | 439/332 |
| 2005/0136723 | A1 * | 6/2005 | Dilliner et al. | 439/320 |
| 2005/0186825 | A1 * | 8/2005 | Yen et al. | 439/336 |
| 2006/0025021 | A1 * | 2/2006 | Ishizaki et al. | 439/677 |
| 2006/0051999 | A1 * | 3/2006 | Allemann et al. | 439/320 |
| 2008/0074027 | A1 * | 3/2008 | Kovacs | 313/318.02 |
| 2008/0248674 | A1 * | 10/2008 | Wehrle et al. | 439/321 |
| 2010/0178788 | A1 * | 7/2010 | Collin | 439/317 |

* cited by examiner

CONNECTOR AND CONNECTOR SET

TECHNICAL FIELD

The present invention relates to a connector and a connector set equipped with a wrong insertion prevention mechanism.

BACKGROUND ART

When connecting a cable etc. for supplying electric power to an electric power device etc., a plug-in connector is often used. A plug-in connector is one which a plug, such as a pin plug to which a cable is connected, for example, is inserted into a socket, such as a receptacle or a socket plug, and thereby they are connected.

In patent document 1 and 2, examples wherein, on a plug or a socket, one set of keys arranged separately along circumferential direction is constructed, and on the socket or the plug, one set of key grooves is arranged along circumferential direction so as to correspond to the one set of keys, in order to prevent wrong insertion of the plug to the socket, are disclosed.

When inserting the plug into the socket, the position of the one set of keys is aligned with the position of one set of key grooves of the socket. Thus, only when the patterns of keys and key grooves match, the plug can be inserted into the socket.

PRIOR ART DOCUMENTS

Patent Documents

Patent document 1: JP-A-H04-259769
Patent document 2: JP-A-2000-208209

SUMMARY OF THE INVENTION

Technical Problem

However, in such an example, in the connector, when inserting the plug into the socket, in order to align the positions of the keys and the key grooves, the plug may have to be largely rotated. In this time, the cable etc. connected to the plug will be in a largely twisted state. Largely twisting a cable increases the strain of the cable, which can lead to degradation, and is not desirable.

The present invention is made in view of the above-mentioned problems, and its object is to provide a connector etc. that can prevent wrong insertion and does not require large rotation of the plug etc. when inserting the plug to the socket.

Means to Solve the Problem

The first invention for attaining the above-mentioned object is a connector comprising a plug and a socket that, for the purpose of preventing wrong insertion, plural protrusions are constructed on one of the plug or the socket separately along circumferential direction, and plural grooves into which the plural protrusions fit are constructed on other, wherein plural sets of the plural grooves are constructed with shifting along circumferential direction.

In the connector of the first invention, since plural sets of grooves are constructed on the plug or the socket, when inserting the plug into the socket, the plug can be inserted by rotating it relative to the socket at various angles. That is, the number of permissible circumferential angles of the plug against the socket is equivalent to the number of sets of grooves. Hence, in this wrong insertion prevention mechanism-type connector, the angle at which the cable connected to the plug etc. is twisted can be reduced at insertion, this is advantageous in that there is little strain on the cable.

The second invention for attaining the above-mentioned object is a connector set comprising plural connectors of the first invention, wherein position pattern of plural protrusions constructed on one of a plug or a socket of one connector is made to differ from position pattern of plural protrusions constructed on one of a plug or a socket of remaining connector; and further, plural sets of the plural grooves constructed on other of the plug or the socket of the one connector are arranged so that position pattern of any given plural grooves does not match position pattern of plural protrusions constructed on the plug or the socket of the remaining connector, for preventing plural protrusions constructed on the plug or the socket of the remaining connector from being inserted.

In the connector set of the second invention, since the plural sets of grooves constructed on the socket etc. of the one connector are arranged so as to prevent the protrusions constructed on the plug etc. of the remaining connectors from being inserted, wrong insertion can be prevented while maintaining the effects of the connector of the first invention, i.e. a composition that allows to insert at plural angles when inserting the plug into the socket.

In the connector set of the second invention, the number of protrusions, the angle between adjacent protrusions, the number of grooves, and the angle between adjacent grooves in the plug or the socket of each connector can be decided by selecting plural patterns from the following patterns 1-4, for example:

Pattern 1: The number of protrusions is two, the angle between adjacent protrusions is 180°, the number of grooves is ten, the angles between adjacent grooves are 40°, 30°, 40°, 40°, 30°, 40°, 30°, 40°, 40°, and 30°.

Pattern 2: The number of protrusions is three, the angle between adjacent protrusions is 120°, the number of grooves is six, the angles between adjacent grooves are 75°, 45°, 75°, 45°, 75°, and 45°.

Pattern 3: The number of protrusions is two, the angle between adjacent protrusions is 90°, the number of grooves is eight, the angles between adjacent grooves are 30°, 40°, 50°, 40°, 70°, 40°, 50°, and 40°.

Pattern 4: The number of protrusions is two, the angle between adjacent protrusions is 60°, the number of grooves is six, the angles between adjacent grooves are 80°, 60°, 50°, 60°, 50°, and 60°

Moreover, the number of protrusions, the angle between adjacent protrusions, the number of grooves, and the angle between adjacent grooves in the plug or the socket of each connector can be decided by selecting plural patterns from the following patterns 1-4:

Pattern 1: The number of protrusions is two, the angle between adjacent protrusions is 180°, the number of grooves is four, the angles between adjacent grooves are 75°, 105°, 75°, and 105°.

Pattern 2: The number of protrusions is three, the angle between adjacent protrusions is 120°, the number of grooves is six, the angles between adjacent grooves are 75°, 45°, 75°, 45°, 75°, and 45°.

Pattern 3: The number of protrusions is two, the angle between adjacent protrusions is 90°, the number of grooves is four, the angles between adjacent grooves are 75°, 90°, 105°, and 90°.

Pattern 4: The number of protrusions is two, the angle between adjacent protrusions is 60°, the number of grooves is four, the angles between adjacent grooves are 105°, 60°, 135°, and 60°.

In addition, the number of protrusions, the angle between adjacent protrusions, the number of grooves, and the angle between adjacent grooves in the plug or the socket of each connector can be decided by selecting plural patterns from the following patterns 1-4:

Pattern 1: The number of protrusions is two, the angle between adjacent protrusions is 180°, the number of grooves is eight, the angles between adjacent grooves are 45°, 30°, 75°, 30°, 45°, 30°, 75°, and 30°.

Pattern 2: The number of protrusions is three, the angle between adjacent protrusions is 120°, the number of grooves is six, the angles between adjacent grooves are 75°, 45°, 75°, 45°, 75°, and 45°.

Pattern 3: The number of protrusions is two, the angle between adjacent protrusions is 90°, the number of grooves is six, the angles between adjacent grooves are 70°, 90°, 70°, 40°, 50°, and 40°.

Pattern 4: The number of protrusions is two, the angle between adjacent protrusions is 60°, the number of grooves is six, the angles between adjacent grooves are 80°, 60°, 50°, 60°, 50°, and 60°.

Furthermore, the number of protrusions, the angle between adjacent protrusions, the number of grooves, and the angle between adjacent grooves in the plug or the socket of each connector can be decided by selecting plural patterns from the following patterns 1-4:

Pattern 1: The number of protrusions is two, the angle between adjacent protrusions is 180°, the number of grooves is ten, the angles between adjacent grooves are 37°, 33°, 30°, 50°, 30°, 37°, 33°, 30°, 50°, and 30°.

Pattern 2: The number of protrusions is three, the angle between adjacent protrusions is 120°, the number of grooves is nine, the angles between adjacent grooves are 43°, 33°, 44°, 43°, 33°, 44°, 43°, 33°, and 44°.

Pattern 3: The number of protrusions is two, the angle between adjacent protrusions is 90°, the number of grooves is ten, the angles between adjacent grooves are 50°, 28°, 39°, 23°, 28°, 39°, 30°, 33°, 57°, and 33°.

Pattern 4: The number of protrusions is two, the angle between adjacent protrusions is 60°, the number of grooves is eight, the angles between adjacent grooves are 28°, 60°, 28°, 60°, 36°, 60°, 28°, and 60°.

In the connector set of this composition, between the plug or the socket of the one connector and the socket or the plug of the remaining connector, the position pattern of plural protrusions and the position pattern of any given plural grooves never match. Therefore, the protrusions does not fit into the grooves even if the plug or the socket of the one connector and the socket or the plug of another connector are rotated relatively, and thus, the plug will not be inserted into the socket. Furthermore, in the position pattern of any given plural grooves of the one connector, at least one of the grooves is made to always shift at a certain angle from position patterns of plural protrusions of the remaining connector; thus, when trying to insert forcibly, forced insertion with change in shape of the protrusion etc. is prevented, thereby ensuring prevention of wrong insertion.

Effect of the Invention

By the present invention, a connector etc. that can prevent wrong insertion, and does not require large rotation of the plug etc. when inserting the plug to the socket, are provided.

BEST MODE FOR CARRYING OUT THE INVENTION

Hereinafter, embodiments of the connector etc. of the present invention will be described with reference to the accompanying drawings.

First, the connector of the first embodiment will be described with reference to FIG. 1 to FIG. 3.

Figure 1:
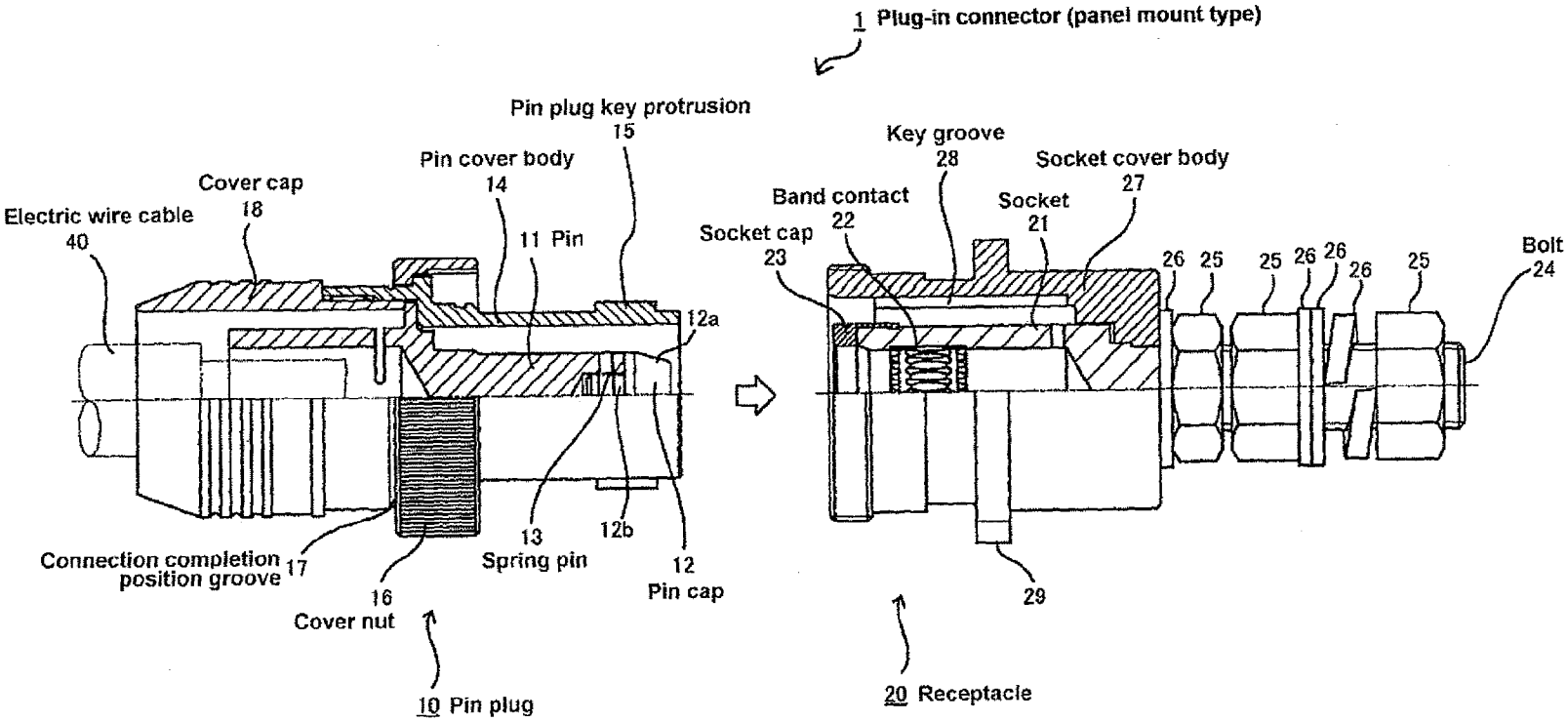
FIG. 1: Figure showing the connection of pin plug 10 and receptacle 20.
Figure 2:
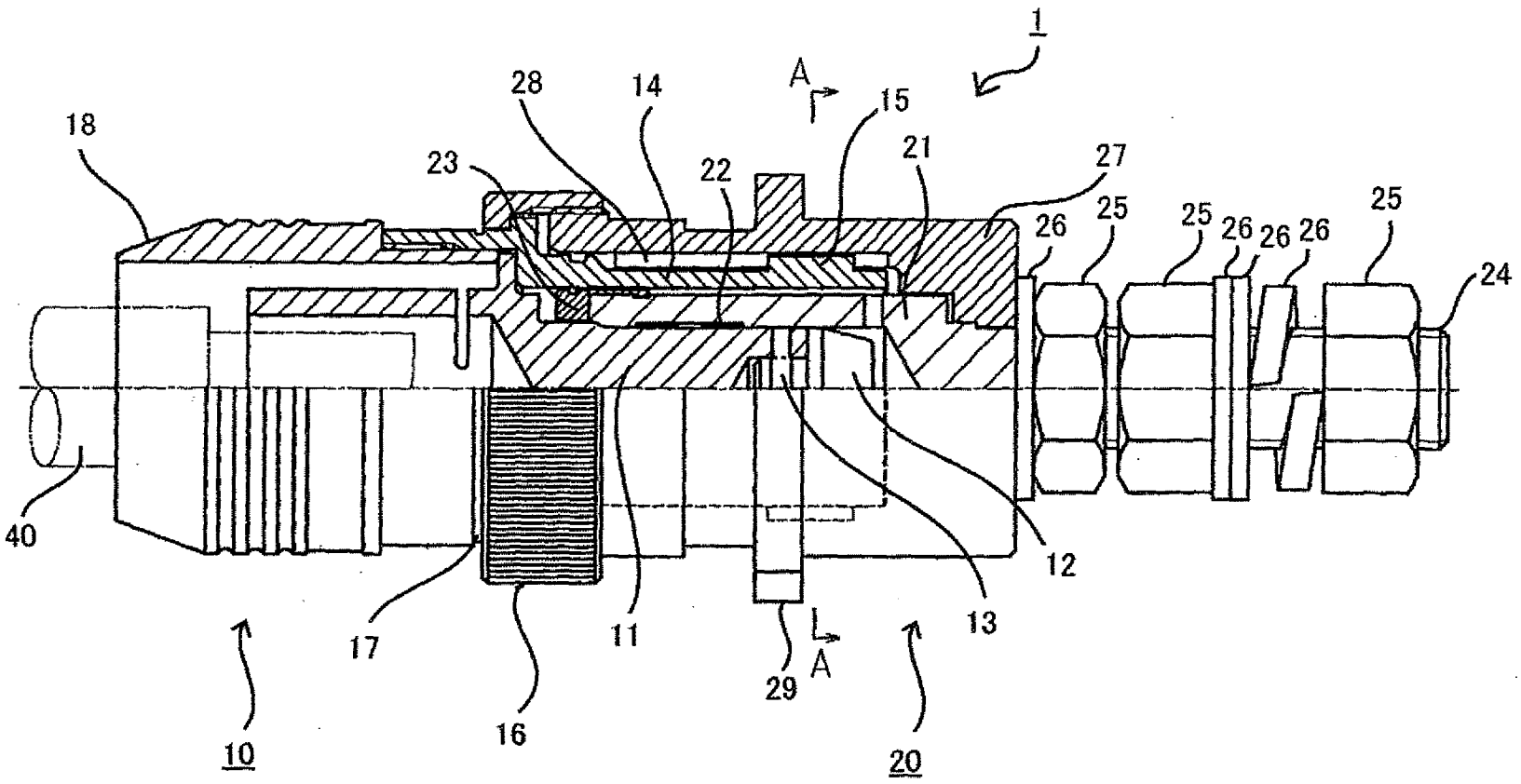
FIG. 2: Figure showing plug-in connector 1, wherein pin plug 10 and receptacle 20 are connected.

As shown in FIG. 1 and FIG. 2, plug-in connector 1, which is a connector, comprises pin plug 10, which is a plug, and receptacle 20, which is a socket; they are connected by inserting pin plug 10 into receptacle 20. Plug-in connector 1 of the present embodiment is a plug-in connector for large current, and is namely a panel mount type, wherein receptacle 20 is attached to a housing etc. that is not shown in the figure.

Pin plug 10 comprises pin 11, pin cap 12, spring pin 13, pin cover body 14, pin plug key protrusion 15, cover nut 16, connection completion position groove 17, and cover cap 18 etc.

There is one pin 11, and its insertion side end is formed in an approximate column shape.

Here, for the components constituting pin plug 10, the insertion side refers to the side which faces receptacle 20 when inserting pin plug 10 into receptacle 20, and for the components constituting receptacle 20, the insertion side refers to the side which faces pin plug 10 when inserting pin plug 10 into receptacle 20. The same may be said for the insertion side of the example of a plug-in connector, wherein pin plug 10 is inserted into socket plug 30, that is to be described later.

At the insertion side tip of pin 11, pin cap 12, which comprises head part 12*a* and shaft part 12*b*, is provided so that shaft part 12*b* is inserted into pin 11 toward its axis direction. In addition, pin cap 12 is fixed by a spring pin 13, which is provided so as to penetrate the insertion side end of pin 11 and the shaft part 12*b* of pin cap 12.

Moreover, electric wire cable 40 is crimped and connected to pin 11 at the end opposite to the insertion side of pin 11.

Figure 7:
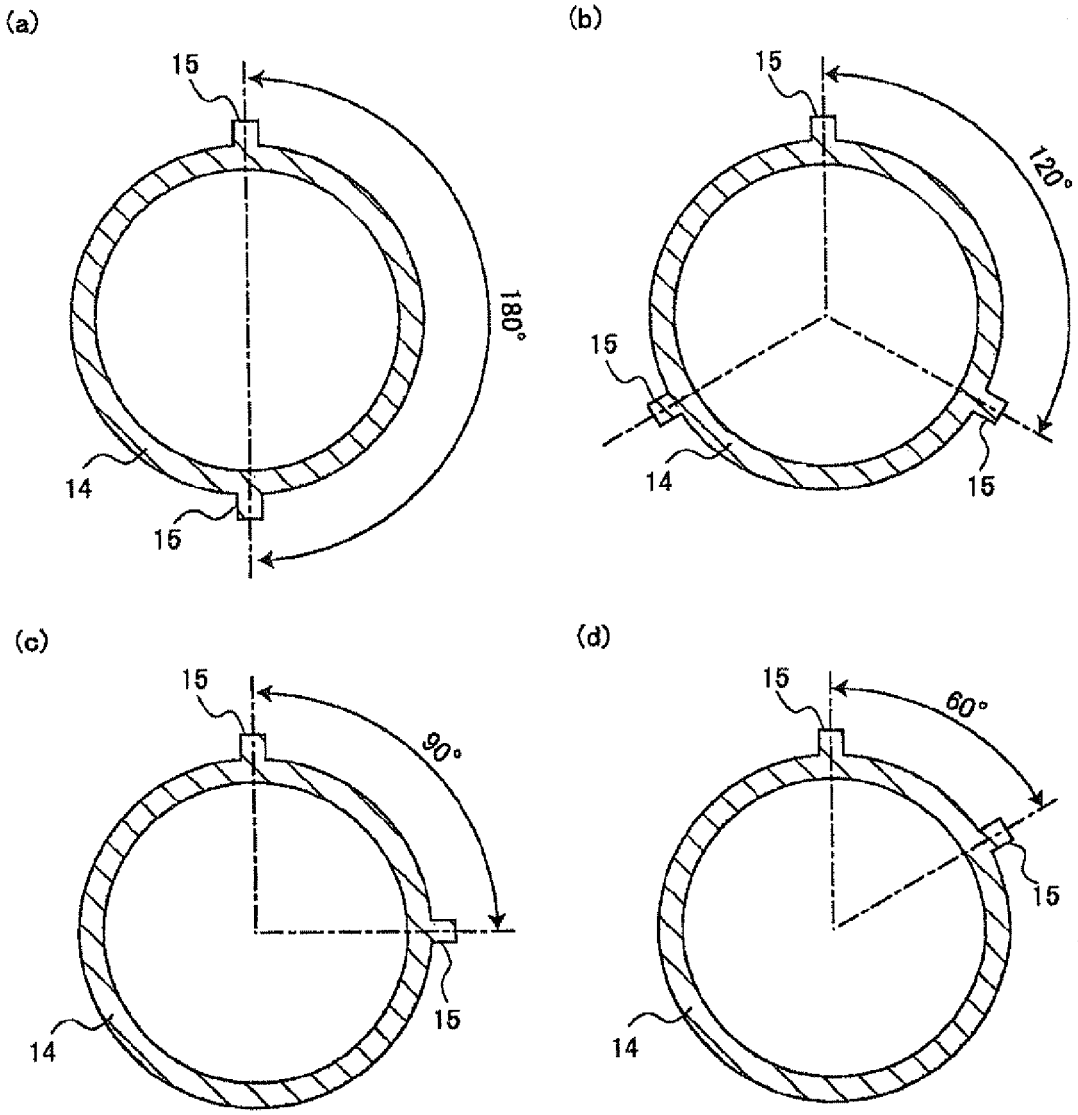
FIG. 7: Figure showing pin plug key protrusions 15.

Pin cover body 14 has an approximately cylindrical shape and is provided at the periphery of the axis direction of pin 11. Pin plug key protrusion 15 is constructed on the outer circumference surface of the insertion side end of pin cover body 14. As shown in FIG. 7(*a*), two pin plug key protrusions 15 are constructed at 180° of separation along the circumferential direction of pin cover body 14. These two pin plug key protrusions 15 constitute one set. However, the number of pin plug key protrusions 15 that constitute one set of pin plug key protrusions 15 and its position pattern, such as separation angle, are not restricted to those described above, as long as plural pin plug key protrusions 15 are constructed.

Cover nut 16 has an approximately cylindrical shape, and is provided at the periphery of the axis direction of pin cover body 14, so that its inner circumference surface of the insertion side end is separated from pin cover body 14. The inner circumference surface has an internal thread.

Cover cap 18 has an approximately cylindrical shape, and is provided at the periphery of the axis direction of pin 11 and electric wire cable 40, at the end opposite to the insertion side of pin 11.

Receptacle 20 comprises socket 21, band contact 22, socket cap 23, bolt 24, nut 25, washer 26, socket cover body 27, key groove 28, and attachment part 29 etc, and is attached to a housing etc., which is not illustrated, via attachment part 29.

The insertion side end of socket 21 is formed in a cylindrical shape. Band contact 22 for ensuring contact with the pin 11 is provided on the inner circumference surface of the insertion side end of socket 21. Socket cap 23 is provided at the tip of the insertion side of socket 21. Moreover, the end opposite to the insertion side of socket 21 is continued to bolt 24, and a bus bar etc., which is not illustrated, is attached to bolt 24 using nut 25 and washer 26.

Socket cover body 27 has an approximately cylindrical shape, and is provided at the periphery of the axis direction of socket 21, so as to separate its inner circumference surface from socket 21 at the insertion side end. Between socket 21 and socket cover body 27, pin cover body 14 of the pin plug 10 is to be inserted. Further, plural key grooves 28 are constructed on the inner circumference surface of the socket cover body 27. These key grooves 28 are grooves that pin plug key protrusions 15 of the pin plug 10 can fit.

Moreover, on the outer circumference surface of the insertion side end of socket cover body 27, an external thread that fits the internal thread on the inner circumference surface of cover nut 16 of the pin plug 10 is constructed.

Figure 3:
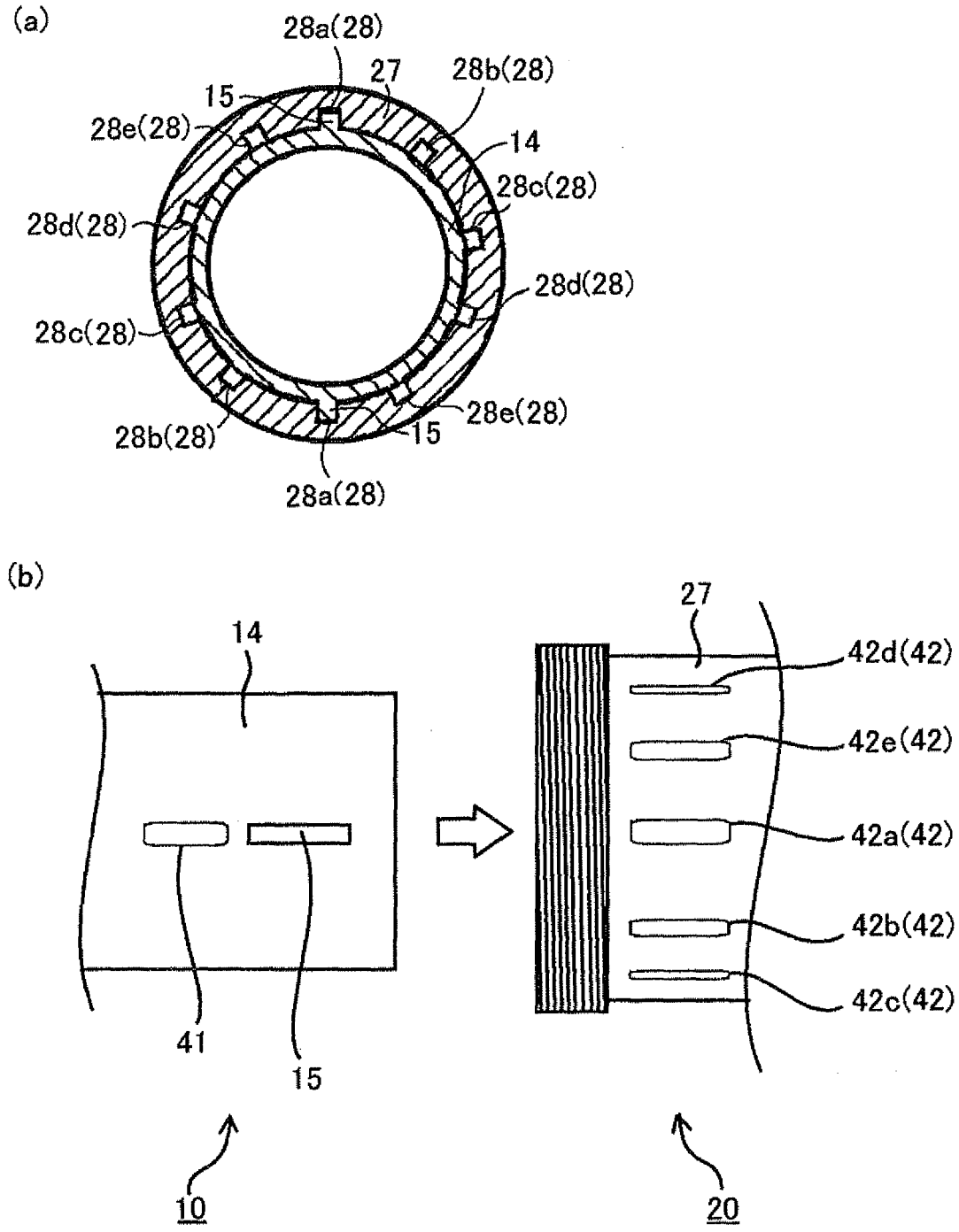
FIG. 3: Figure showing fit of pin plug key protrusions 15 and key grooves 28.

FIG. 3 is a figure showing the fit of pin plug key protrusions 15 and key grooves 28 when pin plug 10 and receptacle 20 is connected; FIG. 3(*a*) is a sectional view at the line A-A in FIG. 2; and FIG. 3(*b*) shows the connection of pin plug 10 and receptacle 20 seen from above. Additionally, in FIG. 3(*a*), illustrations of pin 11 and socket 21 etc. are omitted.

As shown in FIG. 3(*a*), in the present embodiment, as for key groove 28, two key grooves 28 constructed at 180° of separation along the circumferential direction of the inner circumference surface of socket cover body 27, so that one set of pin plug key protrusions 15 fits, constitute one set, and five sets 28*a*-28*e* are arranged with shifting circumferential angle. When pin plug 10 is connected to receptacle 20, one set of pin plug key protrusions 15 fits any one set of key grooves 28 (28*a* in FIG. 3(*a*)).

However, the number of key grooves 28 that constitute one set of key grooves 28 and the position pattern, such as separation angle, are determined to correspond with the position pattern of one set of pin plug key protrusions 15, not restricted to those mentioned above. Moreover, the number of sets of key grooves 28 constructed with shifting along circumferential direction is not restricted to that mentioned above, as long as plural sets are constructed.

Furthermore, as shown in FIG. 3(*b*), alignment marks 41 and 42 (42*a*-42*e*), which indicate alignment at aforementioned fitting, are formed on the outer circumference surface of pin cover body 14 of pin plug 10 and the outer circumference surface of socket cover body 27 of receptacle 20, respectively. Plural alignment marks 42*a*-42*e* formed on socket cover body 27 corresponds to the above-mentioned sets 28*a*-28*e* of key grooves 28, respectively; by inserting pin plug 10 into receptacle 20 with matching the position of alignment mark 41 of pin cover body 14 with any one of alignment marks 42*a*-42*e* of socket cover body 27, the positions of pin plug key protrusions 15 and key grooves 28 are matched and they can be fitted easily.

Attachment part 29 is a plate-like component provided on the outer circumference surface of socket cover body 27 and used for attaching receptacle 20 to a housing etc., which is not illustrated, with a screw etc.

When connecting pin plug 10 to receptacle 20, the position of one set of pin plug key protrusions 15 constructed on the outer circumference surface of pin cover body 14 is matched with the position of any one set of key grooves 28 constructed on the inner circumference surface of socket cover body 27, and pin 11 is inserted along the inner circumference surface of socket 21 with guiding pin plug key protrusions 15 along key grooves 28. Then, pin 11 contacts band contact 22 of socket 21 and electric conduction between them becomes possible. By rotating cover nut 16 to screw together the internal thread on its inner circumference surface with the external thread constructed on the outer circumference surface of socket cover body 27, pin plug 10 is fixed to receptacle 20, not to depart. Additionally, in this time, connection completion position groove 17 become visible. In this way, connection completion position groove 17 serves a purpose of visually confirming the state of connection of pin plug 10 and receptacle 20.

In the connector of this embodiment, since five sets 28*a*-28*e* of key grooves 28 are constructed on receptacle 20 with shifting their circumferential angles, pin plug 10 can be inserted into receptacle 20 at five different angles. Therefore, even if the angles of pin plug 10 and receptacle 20 differ at insertion, a small degree of rotation of pin plug 10 would be enough to insert; thus, the degree of twisting of electric wire cable 40 at connection is reduced, this is advantageous in that the strain on the cable can be decreased.

Next, the connector of the second embodiment will be described.

Figure 4:
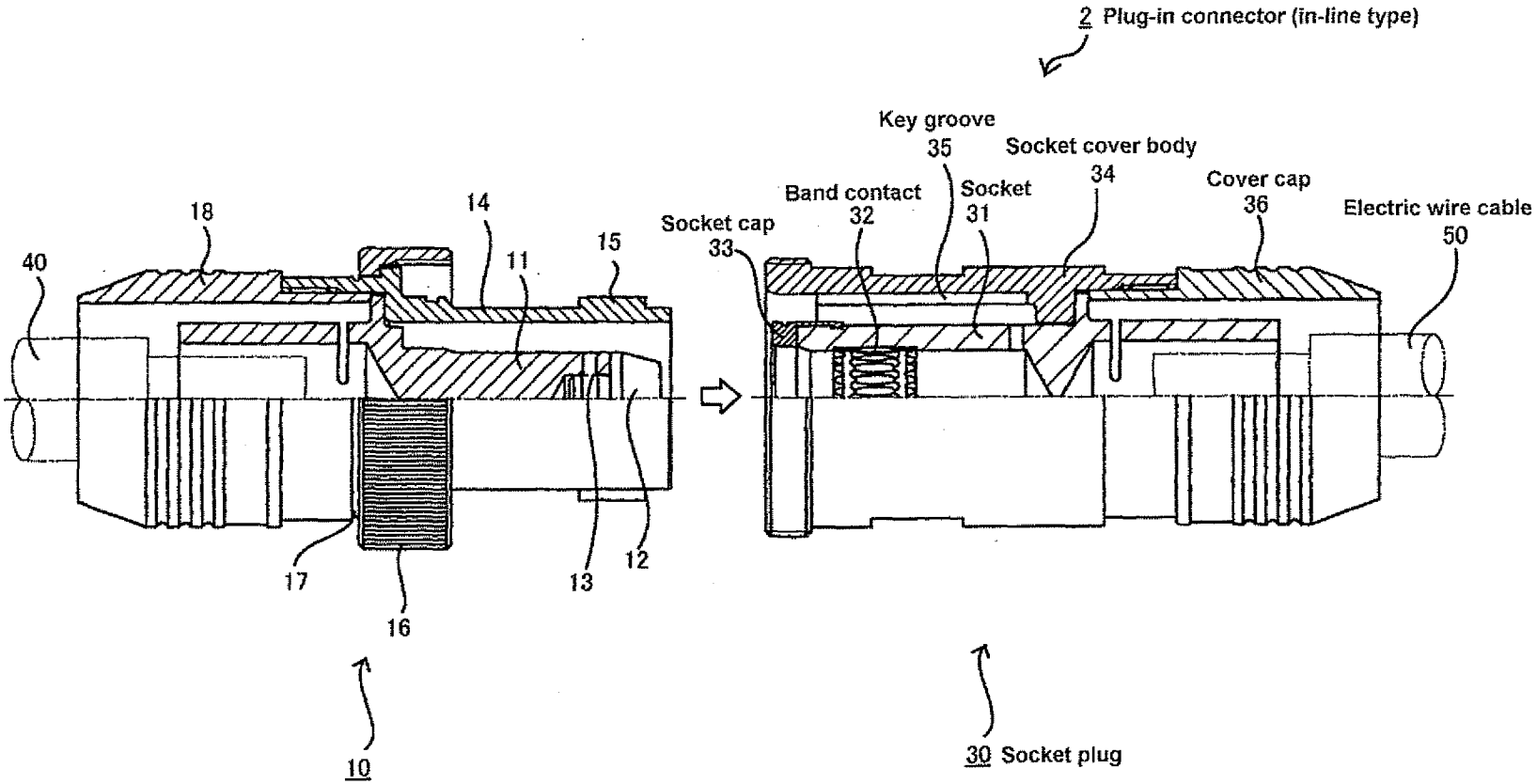
FIG. 4: Figure showing connection of pin plug 10 and socket plug 30.
Figure 5:
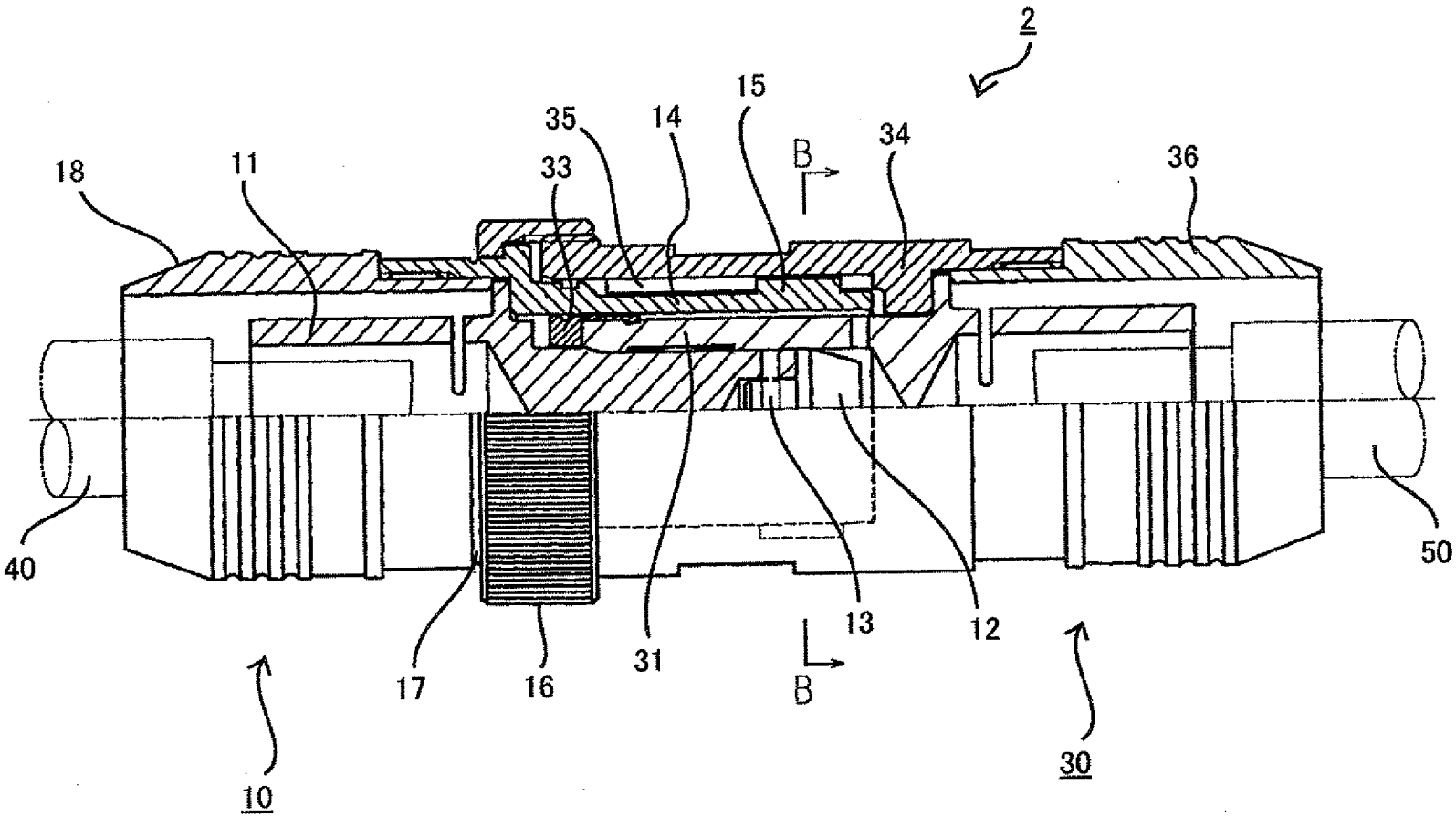
FIG. 5: Figure showing plug-in connector 2, wherein pin plug 10 and the socket plug 30 are connected.

As shown in FIG. 4 and FIG. 5, plug-in connector 2, which is the connector of this embodiment, comprises pin plug 10, which is a plug, and socket plug 30, which is a socket; they are connected by inserting pin plug 10 into socket plug 30. Plug-in connector 2 of the present embodiment is a plug-in connector for large current, and is of a so-called in-line type, wherein pin plug 10 is connected to socket plug 30, to which electric wire cable 50 is connected.

As for pin plug 10, its compositions are approximately equal to the first embodiment; thus, the same symbols are assigned in the figures etc. and description will be abbreviated.

Socket plug 30 comprises socket 31, band contact 32, socket cap 33, socket cover body 34, key groove 35, and cover cap 36 etc.

In socket 31, the insertion side end is formed in an approximately cylindrical shape. Band contact 32 for ensuring contact with the pin 11 is provided on the inner circumference surface at the insertion side end of socket 31. Socket cap 33 is provided at the tip of the insertion side of socket 31. Furthermore, electric wire cable 50 is crimped and connected to the end opposite to the insertion side of socket 31.

Socket cover body 34 has an approximately cylindrical shape, and is provided at the periphery of the axis direction of socket 31, so that its inner circumference surface is separated from socket 31 at the insertion side end. Between socket 31 and socket cover body 34, pin cover body 14 of the pin plug 10 is to be inserted. Further, key grooves 35 are constructed on the inner circumference surface of the socket cover body 34. These key grooves 35 are grooves that pin plug key protrusions 15 of the pin plug 10 can fit.

Moreover, on the outer circumference surface of the insertion side end of socket cover body 34, an external thread, which screws with the internal thread of the inner circumference surface of cover nut 16 of the pin plug 10, is constructed.

Figure 6:
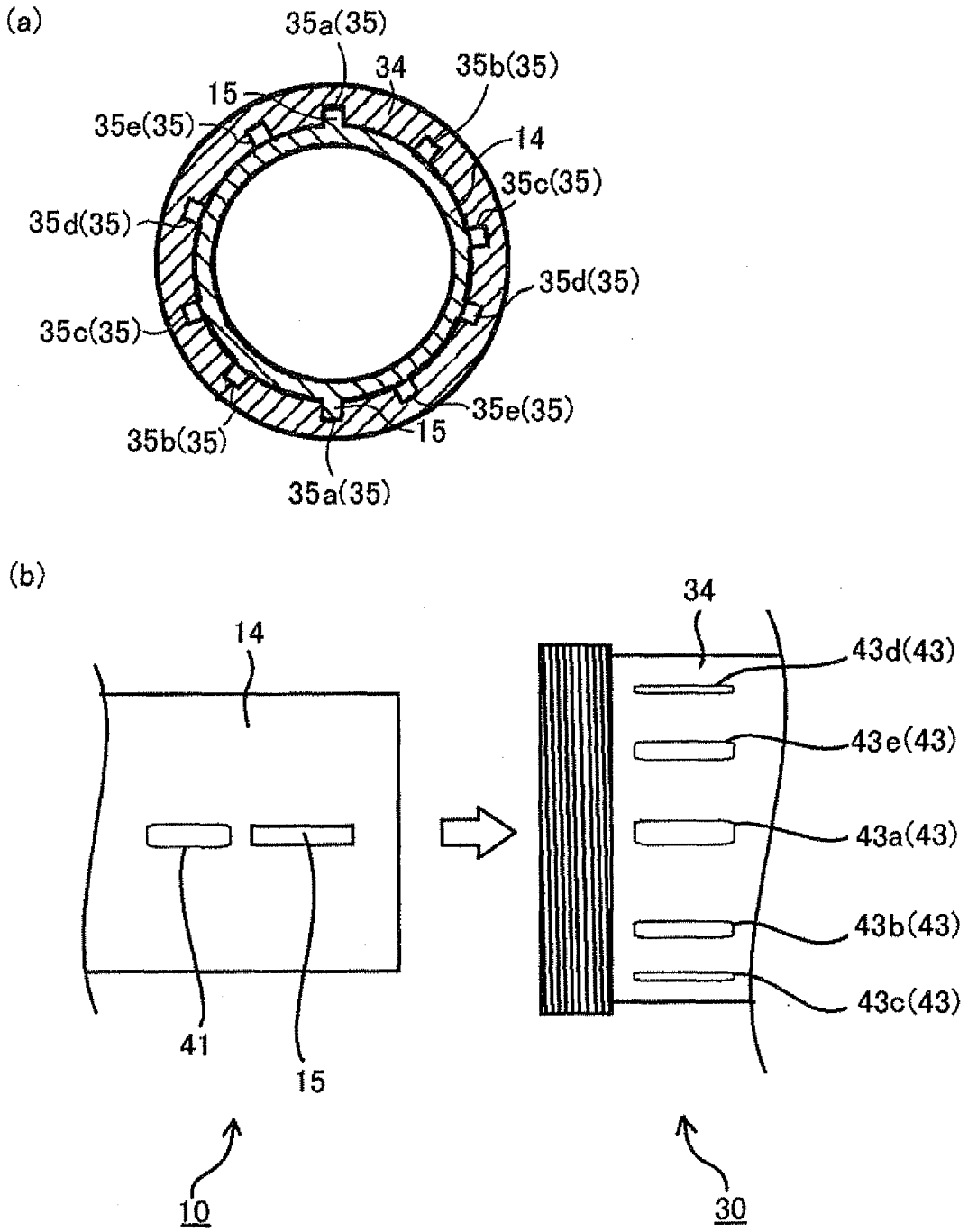
FIG. 6: Figure showing fit of pin plug key protrusions 15 and key grooves 35.

FIG. 6 is a figure showing the fit of pin plug key protrusions 15 and key grooves 35 when pin plug 10 and socket plug 30 are connected; FIG. 6(*a*) is a sectional view at the line B-B in FIG. 5, and FIG. 6(*b*) is a figure showing the connection of pin plug 10 and socket plug 30 seen from above. Additionally, in FIG. 6(*a*), illustration of pin 11 and socket 31 etc. are omitted.

As shown in FIG. 6(*a*), also in the present embodiment, as for key groove 35, two key grooves 35 constructed at 180° of separation along the circumferential direction of the inner circumference surface of socket cover body 34, so that one set of pin plug key protrusions 15 fits, constitute one set, and five sets 35*a*-35*e* are arranged with shifting circumferential angle. When pin plug 10 is connected to socket plug 30, one set of pin plug key protrusions 15 fits any one set of key grooves 35 (35*a* in FIG. 6(*a*)).

However, the number of key grooves 35 that constitute one set of key grooves 35 and the position pattern, such as separation angle, are determined to correspond with the position pattern of one set of pin plug key protrusions 15, not restricted to those mentioned above. Moreover, the number of sets of key grooves 35 constructed with shifting along the circumferential direction is not restricted to that mentioned above, as long as plural sets are constructed.

Furthermore, also in the present embodiment, as shown in FIG. 6(*b*), alignment marks 43 (43*a*-43*e*), which indicate alignment at aforementioned fitting, are formed on the outer circumference surface of socket cover body 34 of socket plug 30. Plural alignment marks 43*a*-43*e* formed on socket cover body 34 corresponds to the above-mentioned sets 35*a*-35*e* of key grooves 35, respectively; by inserting pin plug 10 into socket plug 30 with matching the position of alignment mark 41 of pin cover body 14 with any one of alignment marks 43*a*-43*e* of socket cover body 34, the positions of pin plug key protrusions 15 and key grooves 35 are matched and they can be fitted easily.

The cover cap 36 has an approximately cylindrical shape, and is constructed so as to surround the periphery of the axis direction of socket 31 and electric wire cable 50 at the end opposite to the insertion side of socket 31.

When connecting pin plug 10 to socket plug 30, the position of one set of pin plug key protrusions 15 constructed on the outer circumference surface of pin cover body 14 is matched with the position of any one set of key grooves 35 constructed on the inner circumference surface of socket cover body 34, and pin 11 is inserted along the inner circumference surface of socket 31 with guiding pin plug key protrusions 15 along key grooves 35. Then, pin 11 contacts band contact 32 of socket 31 and electric conduction between them becomes possible. By rotating cover nut 16 to screw together the internal thread on its inner circumference surface with the external thread constructed on the outer circumference surface of socket cover body 34, pin plug 10 is fixed to socket plug 30, not to depart. Additionally, same as the first embodiment, in this time, connection completion position groove 17 become visible.

Also in the connector of this embodiment, same as the aforesaid connector of the first embodiment, the function effect of the reduction of twisting of the cable at connection is achieved.

Additionally, in the above-mentioned embodiments, as shown in FIG. 7(*a*), a case wherein two pin plug key protrusions 15 constructed at separation angle of 180° along the outer circumference surface of pin cover body 14 constitute one set is described; however, the arrangement of pin plug key protrusions 15 is not limited to this.

For example, as shown in FIG. 7(*b*), three pin plug key protrusions 15 constructed at separation angle of 120° may constitute one set; or as shown in FIG. 7(*c*), two constructed at separation angle of 90° may constitute one set; or as shown in FIG. 7(*d*), two constructed at separation angle of 60° may constitute one set. Thus, the number of pin plug key protrusions 15 and the position pattern, such as separation angle, can be determined accordingly. In receptacle 20 and socket plug 30, plural key grooves 28(35) should be constructed so that plural sets of key grooves 28(35), that each set has the position pattern corresponding to that position pattern, are arranged with shifting along the circumferential direction.

Next, an embodiment of the connector set of the present invention will be described.

In addition, hereinafter, the connector set will be described using plug-in connector 1, comprising pin plug 10 and receptacle 20; however, the same can be said for plug-in connector 2, comprising pin plug 10 and socket plug 30.

Figure 8:
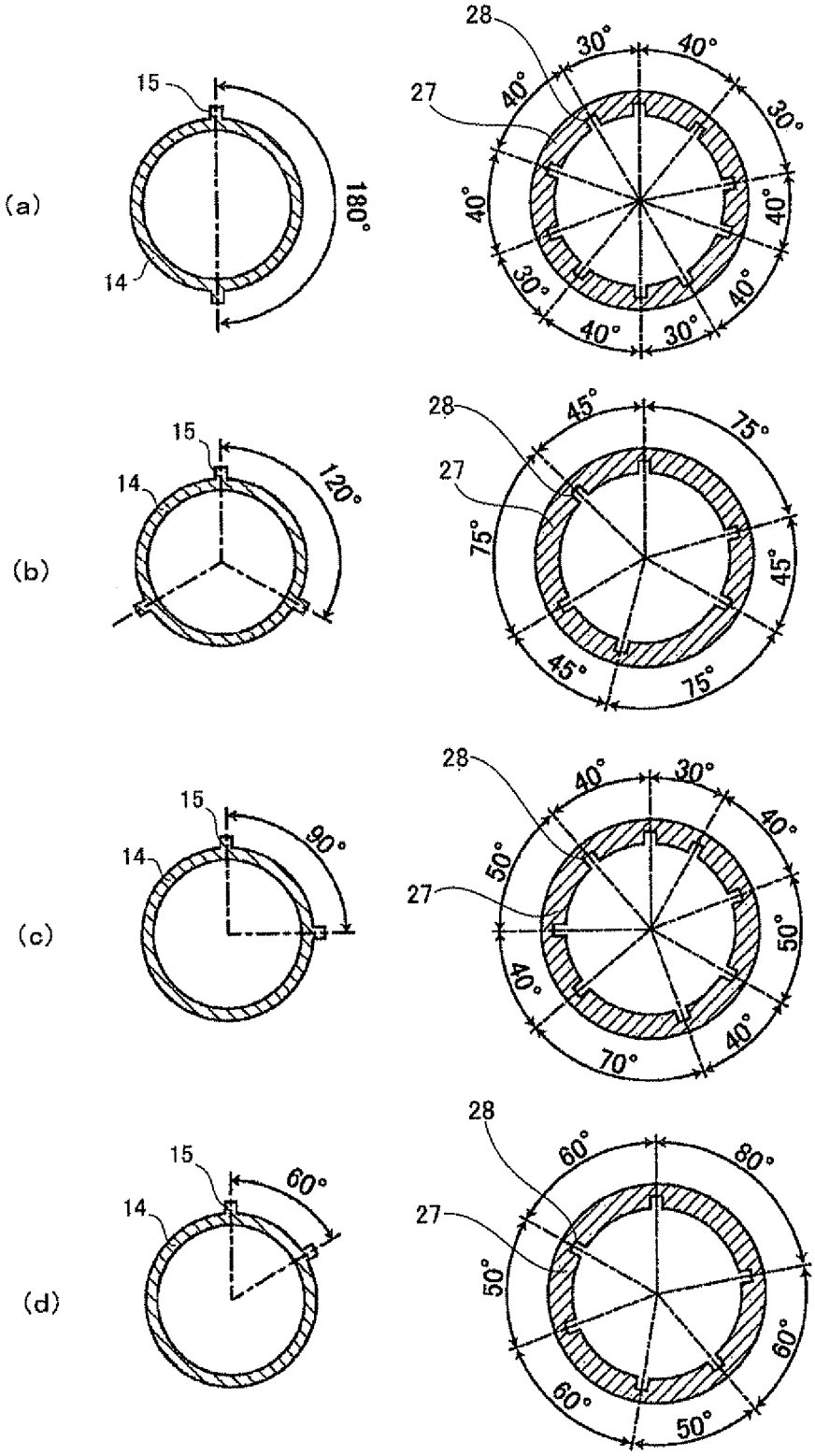
FIG. 8: Figure showing patterns of pin plug key protrusions 15 and key grooves 28.

The connector set of this embodiment comprises four plug-in connectors 1. FIG. 8 shows the combination of position patterns of pin plug key protrusions 15 of pin plug 10 and key grooves 28 of receptacle 20 for each plug-in connector 1, and the combination of pin plug key protrusions 15 and key grooves 28 of each plug-in connector 1 is selected from the four patterns shown as (a) to (d) of each figure. The left-hand side of each figure shows pin plug key protrusions 15, and the right-hand side shows key grooves 28. Since, for pin plug 10 and receptacle 20 of each plug-in connector 1, the components other than pin plug key protrusion 15 and key groove 28 are the same as those mentioned above, descriptions will be omitted.

In the connector set comprising plural plug-in connectors 1, key grooves 28 of receptacle 20 of one plug-in connector 1 should be arranged so that pin plug key protrusions 15 of pin plug 10 of another plug-in connector 1 would not fit.

That is, in receptacle 20, not only one set of key grooves 28 that has the position pattern corresponding to the position pattern of one set of pin plug key protrusions 15 is constructed, but rather, plural sets are constructed with shifting and rotating along the circumferential direction. Therefore, the position pattern formed by combination of given ones of plural key grooves 28 constructed on receptacle 20 of one plug-in connector 1 may turn out to match the position pattern of pin plug key protrusions 15 constructed on pin plug 10 of another plug-in connector 1, thereby causing pin plug 10 of another plug-in connector 1 to fit receptacle 20 of one plug-in connector 1. As a countermeasure, in the present connector set, among plug-in connectors 1, the position of key grooves 28 of receptacle 20 and the position pattern of pin plug key protrusions 15 of pin plug 10 are determined so as to avoid this problem.

The combination of the position patterns of pin plug key protrusions 15 and key grooves 28 constructed on the connector set of this embodiment will be described with reference to FIG. 8.

In pattern 1 shown in FIG. 8(*a*), the number of pin plug key protrusions 15 of pin plug 10 is two, the angle between adjacent pin plug key protrusions 15 (angle between adjacent protrusions) is 180°, the number of key grooves 28 of receptacle 20 is ten, and the angles between adjacent key grooves 28 (angle between adjacent grooves) are 40°, 30°, 40°, 40°, 30°, 40°, 30°, 40°, 40°, and 30°, respectively.

In pattern 2 shown in FIG. 8(*b*), the number of pin plug key protrusions 15 is three, the angle between adjacent protrusions is 120°, the number of key grooves 28 is six, and the angles between adjacent grooves are 75°, 45°, 75°, 45°, 75°, and 45°, respectively.

In pattern 3 shown in FIG. 8(*c*), the number of pin plug key protrusions 15 is two, the angle between adjacent protrusions is 90°, the number of key grooves 28 is eight, and the angles between adjacent grooves are 30°, 40°, 50°, 40°, 70°, 40°, 50°, and 40°, respectively.

In pattern 4 shown in FIG. 8(*d*), the number of pin plug key protrusions 15 is two, the angle between adjacent protrusions is 60°, the number of key grooves 28 is six, and the angles between adjacent grooves are 80°, 60°, 50°, 60°, 50°, and 60°, respectively.

According to each pattern 1 to 4 shown in FIG. 8, in plug-in connector 1 of each pattern, the position pattern formed by any given plural key grooves 28 of receptacle 20 is made so as not to match the position pattern of pin plug key protrusions 15 of pin plug 10 of plug-in connector 1 of different pattern; further, at least one pin plug key protrusion 15 is made to always shift 10° or more from key groove 28.

As described above, in plug-in connector 1, for preventing wrong insertion, a set of pin plug key protrusions 15 is constructed on pin plug 10, and a set of key grooves 28 into which pin plug key protrusion 15 fit is constructed on receptacle 20. Furthermore, since plural sets of key grooves 28 are constructed with shifting along the circumferential direction, when inserting pin plug 10 into receptacle 20, insertion at various angles is possible by rotating them relatively. Thus, this wrong insertion prevention mechanism-type connector can reduce the angle at which the cable connected to the plug etc. is twisted at insertion, this is advantageous in that there is little strain on the cable. The same can be said in the case that receptacle 20 is substituted by socket plug 30.

Further, in the connector set comprising plural plug-in connectors 1, plural sets of key grooves 28 constructed on receptacle 20 of one plug-in connector 1 are arranged so that pin plug key protrusions 15 constructed on pin plug 10 of another plug-in connector 1 does not fit; hence, wrong insertion can be prevented with maintaining the effect of the above-mentioned connector, i.e. composition that allows to insert a plug into a socket at plural angles.

For example, by selecting the combination of arrangements of pin plug key protrusions 15 and key grooves 28 in each plug-in connector 1 of the connector set from the patterns shown in FIG. 8, the position pattern of pin plug key protrusions 15 would not match the position pattern of any given plural key grooves 28 even if pin plug 10 of one plug-in connector 1 is rotated against receptacle 20 of another plug-in connector 1. Furthermore, in the position patterns of any given plural key grooves 28, at least one key groove 28 is made to always shift at a certain angle from the position pattern of aforesaid pin plug key protrusions 15, so when trying to insert forcibly, forcible insertion with changing in shape of protrusion etc. is prevented, thereby preventing wrong insertion with certainty.

In the aforementioned embodiment, the connector set comprising four plug-in connectors 1 is described; however, the connector set is not restricted to that, the number of plug-in connectors that constitute a connector set may be any number other than four, such as two, three, etc. In such a case, for example, in a connector set comprising two plug-in connectors 1, the patterns of pin plug key protrusions 15 and key grooves 28 of each plug-in connector 1 may be selected two arbitrarily from pattern 1 to pattern 4 shown in FIG. 8(*a*) to (*d*).

Figure 9:
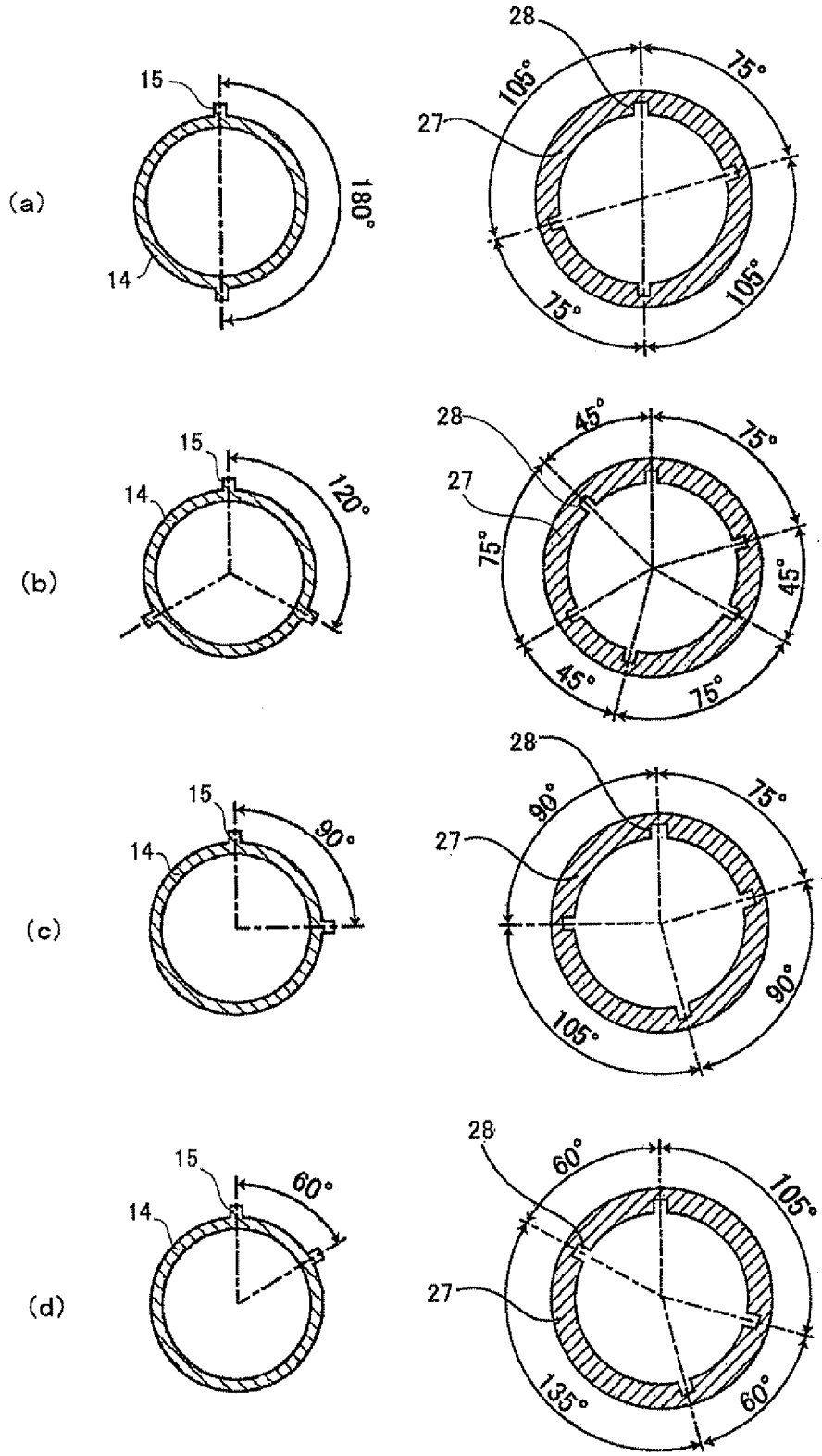
FIG. 9: Figure showing patterns of pin plug key protrusions 15 and key grooves 28.

Moreover, the combination of the position patterns of pin plug key protrusions 15 and key grooves 28 in the connector set are not restricted to those shown in FIG. 8, as well. FIG. 9 shows the combination of position patterns of pin plug key protrusions 15 and key grooves 28 of another embodiment of the connector set.

In pattern 1 shown in FIG. 9(*a*), the number of pin plug key protrusions 15 of pin plug 10 is two, the angle between adjacent protrusions is 180°, the number of key grooves 28 of receptacle 20 is four, and the angles between adjacent grooves are 75°, 105°, 75°, and 105°, respectively.

In pattern 2 shown in FIG. 9(*b*), the number of pin plug key protrusions 15 is three, the angle between adjacent protrusions is 120°, the number of key grooves 28 is six, and the angles between adjacent grooves are 75°, 45°, 75°, 45°, 75°, and 45°, respectively.

In pattern 3 shown in FIG. 9(*c*), the number of pin plug key protrusions 15 is two, the angle between adjacent protrusions is 90°, the number of key grooves 28 is four, and the angles between adjacent grooves are 75°, 90°, 105°, and 90°, respectively.

In pattern 4 shown in FIG. 9(*d*), the number of pin plug key protrusions 15 is two, the angle between adjacent protrusions is 60°, the number of key grooves 28 is four, and the angles between adjacent grooves are 105°, 60°, 135°, and 60°, respectively.

Also in pattern 1 to 4 shown in FIG. 9, same as the example of FIG. 8, in plug-in connector 1 of each pattern, the position pattern formed by any given plural key grooves 28 of receptacle 20 is made so as not to match the position pattern of the pin plug key protrusions 15 of pin plug 10 of plug-in connector 1 of different pattern; further, at least one pin plug key protrusion 15 is made to always shift 15° or more from key groove 28.

The connector set of this embodiment can achieve the same function effects as those of the aforementioned embodiment, as well.

Figure 10:
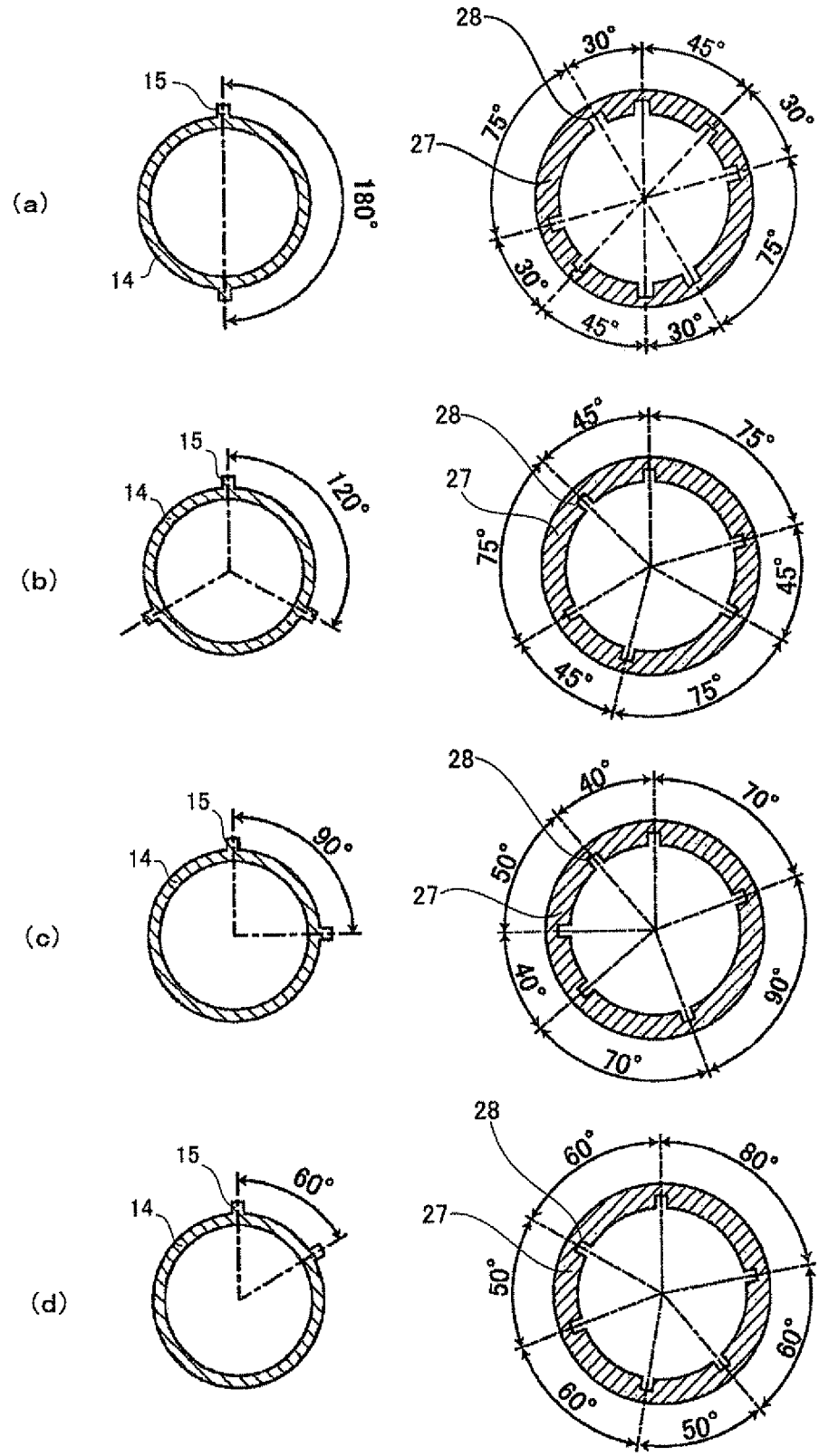
FIG. 10: Figure showing patterns of pin plug key protrusions 15 and key grooves 28.

FIG. 10 shows the combination of position patterns of pin plug key protrusions 15 and key grooves 28 of yet another embodiment of the connector set.

In pattern 1 shown in FIG. 10(*a*), the number of pin plug key protrusions 15 of pin plug 10 is two, the angle between adjacent protrusions is 180°, the number of key grooves 28 of receptacle 20 is eight, and the angles between adjacent grooves are 45°, 30°, 75°, 30°, 45°, 30°, 75° and 30°, respectively.

In pattern 2 shown in FIG. 10(*b*), the number of pin plug key protrusions 15 is three, the angle between adjacent protrusions is 120°, the number of key grooves 28 is six, and the angles between adjacent grooves are 75°, 45°, 75°, 45°, 75°, and 45°, respectively.

In pattern 3 shown in FIG. 10(*c*), the number of pin plug key protrusions 15 is two, the angle between adjacent protrusions is 90°, the number of key grooves 28 is six, and the angles between adjacent grooves are 70°, 90°, 70°, 40°, 50°, and 40°, respectively.

In pattern 4 shown in FIG. 10(*d*), the number of pin plug key protrusions 15 is two, the angle between adjacent protrusions is 60°, the number of key grooves 28 is six, and the angles between adjacent grooves are 80°, 60°, 50°, 60°, 50°, and 60°, respectively.

Also in pattern 1 to 4 shown in FIG. 10, same as the example of FIG. 8 and FIG. 9, in plug-in connector 1 of each pattern, the position pattern formed by any given plural key grooves 28 of receptacle 20 is made so as not to match the position pattern of pin plug key protrusions 15 of pin plug 10 of plug-in connector 1 of different pattern; further, at least one pin plug key protrusion 15 is made to always shift 10° or more from key groove 28.

The connector set of this embodiment can achieve the same function effects as those of the aforementioned embodiments, as well.

Figure 11:
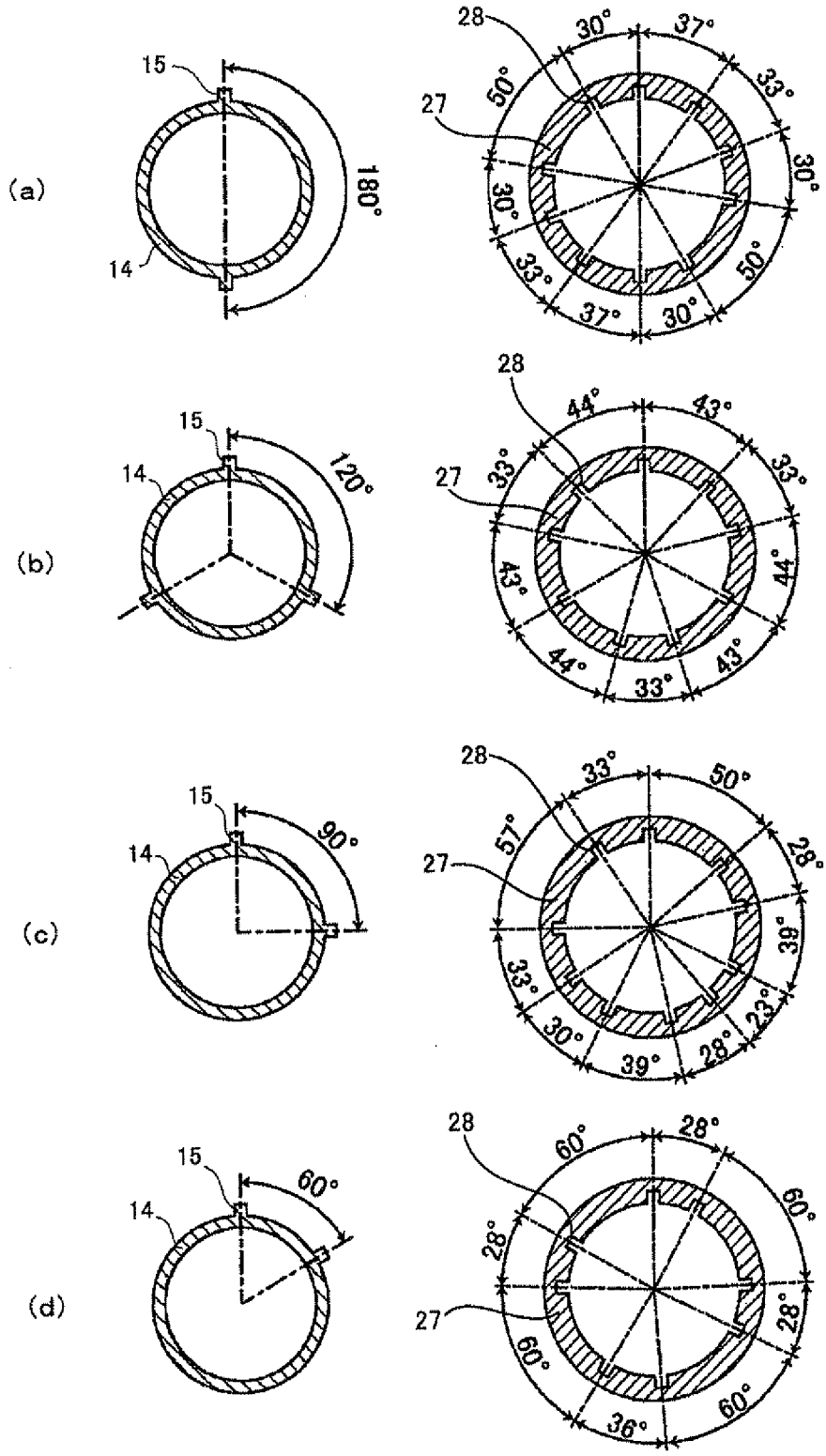
FIG. 11: Figure showing patterns of pin plug key protrusions 15 and key grooves 28.

FIG. 11 shows the combination of position patterns of pin plug key protrusions 15 and key grooves 28 of yet another embodiment of the connector set.

In pattern 1 shown in FIG. 11(*a*), the number of pin plug key protrusions 15 of pin plug 10 is two, the angle between adjacent protrusions is 180°, the number of key grooves 28 of receptacle 20 is ten, and the angles between adjacent grooves are 37°, 33°, 30°, 50°, 30°, 37°, 33°, 30°, 50° and 30°, respectively.

In pattern 2 shown in FIG. 11(*b*), the number of pin plug key protrusions 15 is three, the angle between adjacent protrusions is 120°, the number of key grooves 28 is nine, and the angles between adjacent grooves are 43°, 33°, 44°, 43°, 33°, 44°, 43°, 33° and 44°, respectively.

In pattern 3 shown in FIG. 11(*c*), the number of pin plug key protrusions 15 is two, the angle between adjacent protrusions is 90°, the number of key grooves 28 is ten, and the angles between adjacent grooves are 50°, 28°, 39°, 23°, 28°, 39°, 30°, 33°, 57° and 33°, respectively.

In pattern 4 shown in FIG. 11(*d*), the number of pin plug key protrusions 15 is two, the angle between adjacent protrusions is 60°, the number of key grooves 28 is eight, and the angles between adjacent grooves are 28°, 60°, 28°, 60°, 36°, 60°, 28° and 60°, respectively.

Also in pattern 1 to 4 shown in FIG. 11, same as the examples of FIG. 8 to FIG. 10, in plug-in connector 1 of each pattern, the position pattern formed by any given plural key grooves 28 of receptacle 20 is made so as not to match the position pattern of pin plug key protrusions 15 of pin plug 10 of plug-in connector 1 of different pattern.

The connector set of this embodiment can achieve the same function effects as those of the aforementioned embodiments, as well. In this way, the combination of position patterns of pin plug key protrusions 15 and key grooves 28 in the connector set can be determined accordingly, for the purpose of enabling the prevention of wrong insertion, with maintaining the composition which allows to insert a plug into a socket at plural angles.

Although favorable embodiments of the connector etc. related to the present invention have so far been described in detail with reference to the accompanying figures, the present invention is not limited to these examples. In the technical scope disclosed in the present application, the person having ordinary skill in the art being able to have ideas of various modified or altered examples is naturally understood. And these are concluded in the technical scope of this invention.

For example, in each embodiments, protrusions are described as being constructed on pin plug 10, which is a plug, and grooves are described as being constructed on receptacle 20 or socket plug 30, which is a socket, for the prevention of wrong insertion, but these can also be reversed.

Moreover, each embodiment is described using a plug-in connector for large current, but the present invention is not limited to such, and also in other types of connectors, the above-mentioned composition of pin plug key protrusions 15 and key grooves 28 can be used accordingly. Every component other than the compositions of pin plug key protrusion 15 and key groove 28 is not restricted to those mentioned above, as well, and can be changed accordingly.

| List of Reference Signs | |
|---|---|
| 1, 2 | Plug-in connector |
| 10 | Pin plug |
| 11 | Pin |
| 14 | Pin cover body |
| 15 | Pin plug key protrusion |
| 20 | Receptacle |
| 21, 31 | Socket |
| 27, 34 | Socket cover body |
| 28, 35 | Key groove |
| 30 | Socket plug |
| 40, 50 | Electric wire cable |

The invention claimed is:

1. A connector comprising a plug and a socket that, for the purpose of preventing wrong insertion, plural protrusions are disposed on one of the plug or the socket separately along a circumferential direction, and plural grooves into which the plural protrusions fit are disposed on an other one of the plug or the socket, wherein plural sets of the plural grooves are disposed along the circumferential direction, so that a total number of the plural grooves is greater than a total number of the protrusions, and the sets of plural grooves are shifted from one another along the circumferential direction.

2. A connector set comprising plural connectors of claim 1, wherein a first position pattern of the plural protrusions on one of the plug or the socket of one of the plural connectors differs from a second position pattern of the plural protrusions on one of the plug or the socket of remaining ones of the plural connectors; and the plural sets of the plural grooves on the other of the plug or the socket of the one of the plural connectors are arranged so that a position pattern of any given plural grooves does not match a position pattern of the plural protrusions constructed on the plug or the socket of the remaining ones of the plural connectors, for preventing the plural protrusions constructed on the plug or the socket of the remaining ones of the plural connectors from being incorrectly inserted.

3. The connector of claim 2, wherein a first circumferential angle between adjacent grooves of the plural grooves of a first one of the plural sets of the grooves is the same as a second circumferential angle between adjacent ones of the plural grooves of a second one of the plural sets of grooves, and the first and second circumferential angles are different than a circumferential angle between one of the plural grooves of the first set of plural grooves and an adjacent one of the plural grooves of the second set of plural grooves.

4. The connector of claim 1, wherein a first circumferential angle between adjacent grooves of the plural grooves of a first one of the plural sets of the grooves is the same as a second circumferential angle between adjacent ones of the plural grooves of a second one of the plural sets of grooves, and the first and second circumferential angles are different than a circumferential angle between one of the plural grooves of the first set of plural grooves and an adjacent one of the plural grooves of the second set of plural grooves.

* * * * *